US009169588B2

(12) United States Patent
Tokura

(10) Patent No.: US 9,169,588 B2
(45) Date of Patent: Oct. 27, 2015

(54) SEWING MACHINE

(71) Applicant: BROTHER KOGYO KABUSHIKI KAISHA, Nagoya-shi, Aichi-ken (JP)

(72) Inventor: Masashi Tokura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/632,451

(22) Filed: Feb. 26, 2015

(65) Prior Publication Data

US 2015/0252503 A1 Sep. 10, 2015

(51) Int. Cl.
*G06F 7/66* (2006.01)
*D05B 19/12* (2006.01)

(52) U.S. Cl.
CPC ..... *D05B 19/12* (2013.01)

(58) Field of Classification Search
CPC ..... D05B 19/00; D05B 19/02; D05B 19/04; D05B 19/0812
USPC ..... 112/470.01; 700/136–138
See application file for complete search history.

(56) References Cited

U.S. PATENT DOCUMENTS

| | | | | |
|---|---|---|---|---|
| 4,655,149 | A | 4/1987 | Szydlek | |
| 4,998,489 | A * | 3/1991 | Hisatake et al. | 112/103 |
| 5,042,410 | A * | 8/1991 | Nakashima | 112/445 |
| 5,072,680 | A * | 12/1991 | Nakashima | 112/445 |
| 5,095,835 | A * | 3/1992 | Jernigan et al. | 112/475.05 |
| 5,195,451 | A * | 3/1993 | Nakashima | 112/102.5 |
| 5,323,722 | A * | 6/1994 | Goto et al. | 112/102.5 |
| 6,161,491 | A * | 12/2000 | Takenoya et al. | 112/102.5 |
| 7,392,755 | B2 * | 7/2008 | Kato et al. | 112/102.5 |
| 2009/0188415 | A1 * | 7/2009 | Tokura | 112/470.01 |
| 2011/0226170 | A1 | 9/2011 | Tokura | |
| 2014/0090587 | A1 * | 4/2014 | Ichiyanagi et al. | 112/470.04 |

FOREIGN PATENT DOCUMENTS

| | | | |
|---|---|---|---|
| JP | S62254796 | A | 11/1987 |
| JP | H049603 | A | 1/1992 |
| JP | H04256772 | A | 9/1992 |
| JP | 2008188148 | A | 8/2008 |
| JP | 2011194043 | A | 10/2011 |

* cited by examiner

*Primary Examiner* — Nathan Durham
(74) *Attorney, Agent, or Firm* — Oliff PLC

(57) ABSTRACT

A sewing machine includes a bed, an irradiating portion configured to irradiate laser light onto a specific position on the bed, an image capturing portion configured to capture an image of an area including the specific position and to generate captured image data, a processor, and a memory configured to store computer-readable instructions. The computer-readable instructions, when executed by the processor, cause the sewing machine to perform processes that include causing the irradiating portion to intermittently irradiate the laser light onto the specific position, acquiring the captured image data by causing the image capturing portion to capture an image of the area in synchronization with irradiation on the specific position, and identifying irradiated coordinates based on the captured image data. The irradiated coordinates are coordinates, in the captured image, of an irradiated position. The irradiated position is a position, in the area, onto which the laser light is irradiated.

6 Claims, 9 Drawing Sheets

SEWING MACHINE

CROSS-REFERENCE TO RELATED APPLICATION

This application claims priority to Japanese Patent Application No. 2014-046187 filed Mar. 10, 2014, the content of which is hereby incorporated herein by reference.

BACKGROUND

The present disclosure relates to a sewing machine that includes an image capturing portion.

A sewing machine is known that includes a projecting portion and an image capturing portion. For example, in a known sewing machine, based on generated projection image data, the projecting portion irradiates projection light onto a sewing workpiece and thus projects a pattern. The image capturing portion captures an image of the pattern projected on the sewing workpiece and generates captured image data. The sewing machine identifies a position of the pattern based on the captured image data. The identified position of the pattern is used to calculate a thickness of the sewing workpiece.

SUMMARY

In a case where the sewing workpiece has a color or a design, the pattern projected by the projection light may overlap with the color or the design of the sewing workpiece. In this case, there is a possibility that the sewing machine cannot identify the position of the pattern, due to the color or the design of the sewing workpiece.

Embodiments of the broad principles derived herein provide a sewing machine that is capable of identifying, in a stable manner, a position of light irradiated onto an area whose image can be captured by an image capturing portion, based on captured image data generated by the image capturing portion, without being influenced by a color or a design of a sewing workpiece.

Embodiments provide a sewing machine that includes a bed, an irradiating portion, an image capturing portion, a processor, and a memory. The irradiating portion is configured to irradiate laser light onto a specific position on the bed. The image capturing portion is configured to capture an image of an area including the specific position on the bed and to generate captured image data being data of the captured image. The memory is configured to store computer-readable instructions. The computer-readable instructions, when executed by the processor, cause the sewing machine to perform processes that include causing the irradiating portion to intermittently irradiate the laser light onto the specific position, acquiring the captured image data by causing the image capturing portion to capture an image of the area in synchronization with irradiation on the specific position by the irradiating portion, and identifying irradiated coordinates based on the captured image data. The irradiated coordinates are coordinates, in the captured image, of an irradiated position. The irradiated position is a position, in the area, onto which the laser light is irradiated by the irradiating portion.

BRIEF DESCRIPTION OF THE DRAWINGS

Embodiments will be described below in detail with reference to the accompanying drawings in which.

DETAILED DESCRIPTION

Hereinafter, embodiments will be explained with reference to the drawings. A physical configuration of a sewing machine 1 according to a first embodiment will be explained with reference to FIGS. 1 and 2. The up-down direction, the lower right, the upper left, the lower left, and the upper right of FIG. 1 respectively correspond to the up-down direction, the front, the rear, the left, and the right of the sewing machine 1. A longer direction of a bed 11 and an arm 13 is the left-right direction of the sewing machine 1. A side on which a pillar 12 is disposed is the right side of the sewing machine 1. A direction in which the pillar 12 extends is the up-down direction of the sewing machine 1.

Figure 1:
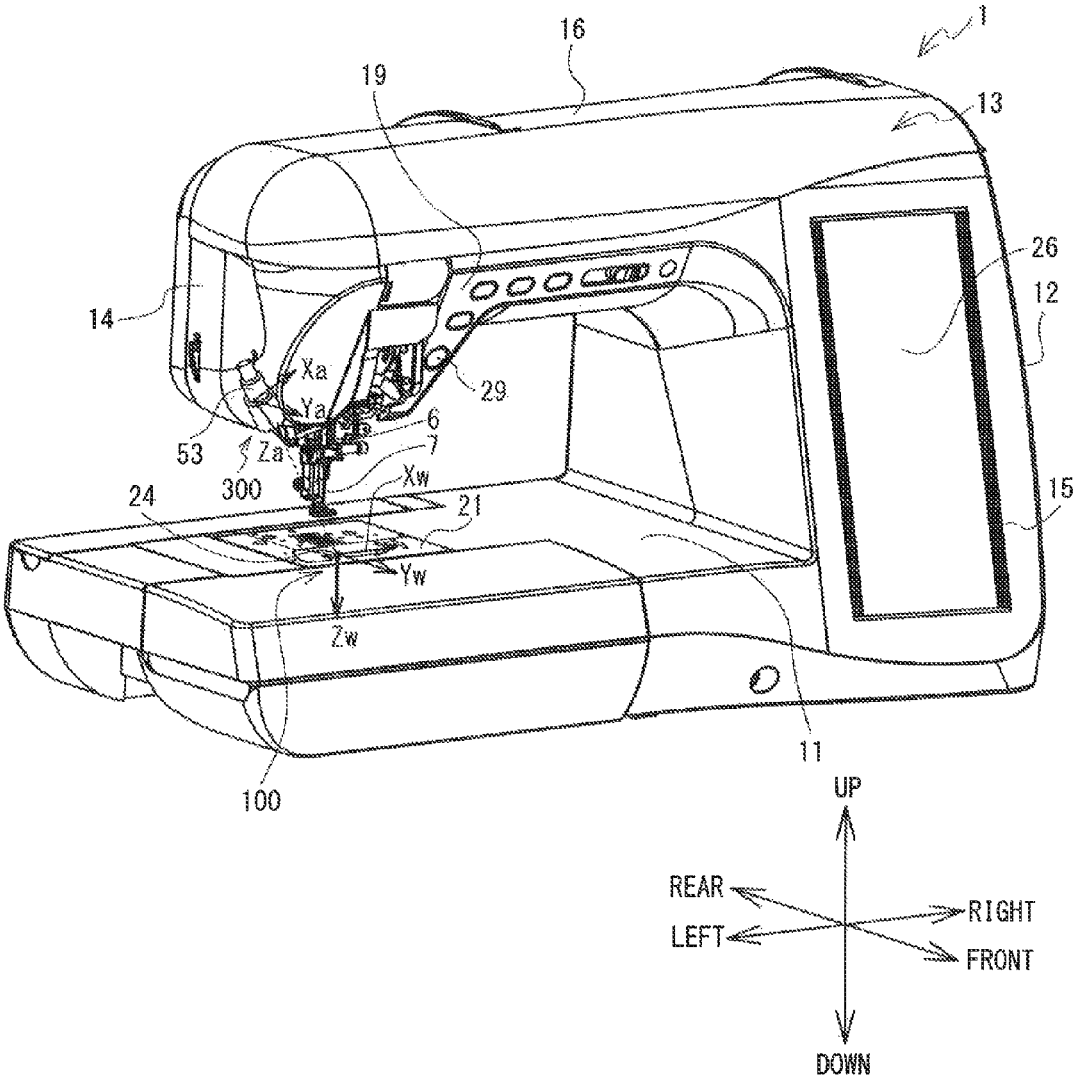
FIG. 1 is a perspective view of a sewing machine according to a first embodiment.

As shown in FIG. 1, the sewing machine 1 includes the bed 11, the pillar 12, the arm 13, and a head 14. The bed 11 is a base portion of the sewing machine 1 and extends in the left-right direction. The pillar 12 extends upward from the right end portion of the bed 11. The arm 13 extends to the left from the upper end portion of the pillar 12, facing the bed 11. The head 14 is a portion that is connected to the left leading end portion of the arm 13.

A needle plate 21 is provided on the top surface of the bed 11. The needle plate 21 has a needle hole (not shown in the drawings). The sewing machine 1 includes a feed dog, a feed mechanism, a shuttle mechanism, and the like, which are not shown in the drawings, underneath the needle plate 21 (namely, inside the bed 11). In a case where normal sewing, which is not embroidery sewing, is performed, the feed dog 23 is driven by the feed mechanism to feed a sewing workpiece 10 (refer to FIG. 5), such as a work cloth, by a predetermined feed amount. The shuttle mechanism may cause an upper thread (not shown in the drawings) to be entwined with a lower thread (not shown in the drawings), underneath the needle plate 21.

The liquid crystal display (LCD) 15 is provided on the front surface of the pillar 12. An image including various items, such as a command, an illustration, a setting value, a message, etc., may be displayed on the LCD 15. A touch panel 26, which can detect a pressed position, is provided on the front surface side of the LCD 15. When the user performs a pressing operation on the touch panel 26 using a finger or a stylus pen (not shown in the drawings), the pressed position may be detected by the touch panel 26. A CPU 61 (refer to FIG. 3) of the sewing machine 1 may recognize an item selected on the image, based on the detected pressed position. Hereinafter, the pressing operation on the touch panel 26 by the user is referred to as a panel operation. By a panel operation, the user may select a pattern that the user desires to sew, or may select a command to be executed etc. A sewing machine motor 81 (refer to FIG. 3) is provided inside the pillar 12.

A cover 16 is provided on an upper portion of the arm 13 such that the cover 16 can be opened and closed. Although not shown in the drawings, a thread storage portion is provided below the cover 16, that is, inside the arm 13. The thread storage portion may house a thread spool (not shown in the drawings) on which the upper thread is wound. The drive shaft (not shown in the drawings), which extends in the left-right direction, is provided inside the arm 13. The drive shaft is rotationally driven by the sewing machine motor 81. Various switches, including a start/stop switch 29, are provided on the lower left portion of the front surface of the arm 13. The start/stop switch 29 is used to input an instruction to start or stop the operation of the sewing machine 1, namely, to start or stop sewing.

Figure 2:
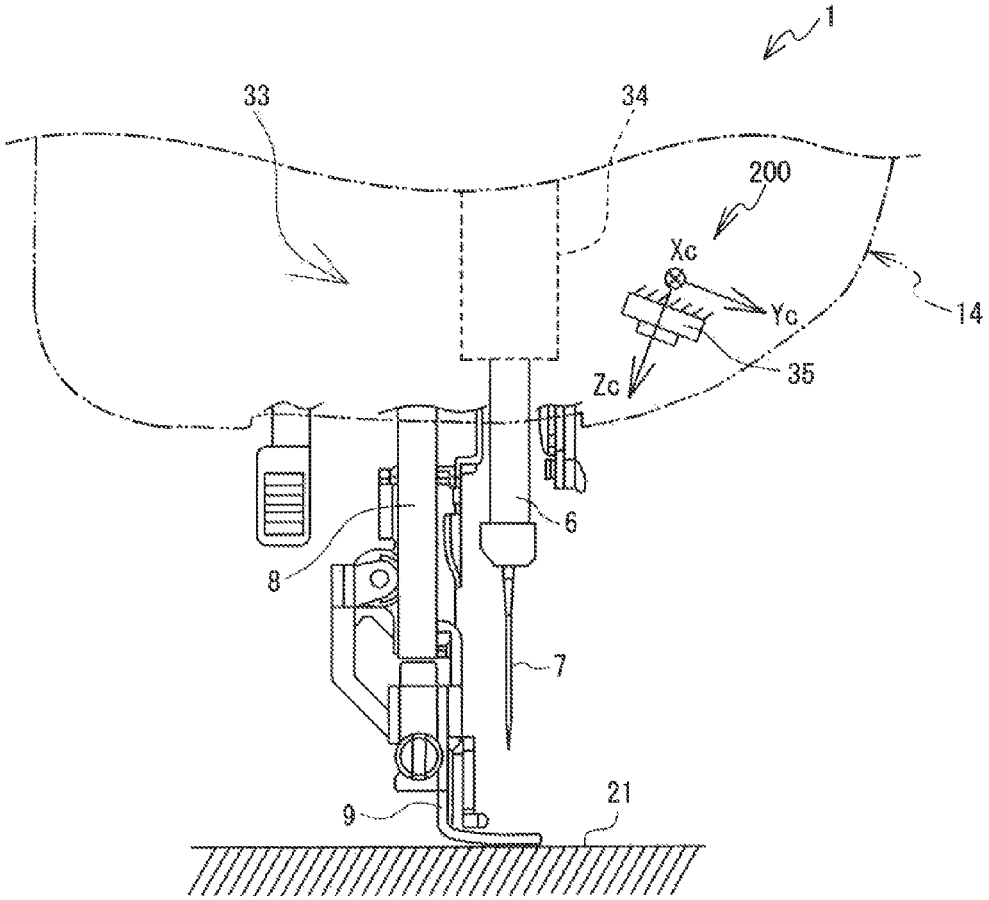
FIG. 2 is an explanatory diagram showing a configuration in the vicinity of an imaging device according to the first embodiment.

As shown in FIG. 2, the needle bar 6, a presser bar 8, a needle bar up-and-down movement mechanism 34, a laser device 53 (refer to FIG. 1), etc. are provided on the head 14. The needle bar 6 and the presser bar 8 extend downward from the lower end portion of the head 14. A sewing needle 7 may be removably attached to the lower end of the needle bar 6. The presser foot 9 may be removably attached to the lower end portion of the presser bar 8. The needle bar up-and-down movement mechanism 34 drives the needle bar 6 in the up-down direction as a result of the rotation of the drive shaft. The sewing machine 1 includes the needle bar 6, the needle bar up-and-down movement mechanism 34, and the sewing machine motor 81 (refer to FIG. 3) as a sewing portion 33.

As shown in FIG. 1, the laser device 53 is arranged on the left front portion of the head portion 14. The laser device 53 is a device that can intermittently irradiate red laser light onto a specific position 24 on the needle plate 21 (namely, on the bed 11). More specifically, the laser device 53 irradiates laser light a plurality of times per second onto the specific position 24, by causing a light source (not shown in the drawings) that is provided inside the laser device 53 to flash at a uniform interval. Hereinafter, the operation by which the laser device 53 causes the light source to flash is referred to as "pulsed light emission." In the present embodiment, a cycle T of the pulsed light emission by the laser device 53 is 60 Hz. In other words, the laser device 53 performs the pulsed light emission by repeatedly alternating between illuminating the light source for 1/120th of a second and extinguishing the light source for 1/120th of a second. The laser light output of the laser device 53 of the present embodiment is 15 mW. In this way, the sewing machine 1 can adopt the laser device 53 that satisfies standards established by safety criteria of laser products (such as the Japanese Industrial Standards (JIS) C6802 and IEC 60825-1, for example).

As shown in FIG. 2, an imaging device 35 is provided inside the head portion 14. The imaging device 35 is, for example, a rolling shutter type imaging device that includes a known complementary metal oxide semiconductor (CMOS) image sensor. The CMOS image sensor includes phototransistors (not shown in the drawings) corresponding to pixels of an image captured by the imaging device 35. Each of the phototransistors is connected to a capacitor (not shown in the drawings), which can accumulate an electric charge. When exposure by the imaging device 35 is performed, an electric current is generated in each of the phototransistors in accordance with an amount of light received. In this way, an electric charge is accumulated in the capacitor corresponding to each of the phototransistors. A frame rate of the imaging device 35 according to the present embodiment is 60 frames per second (fps). When the exposure by the imaging device 35 is performed, each of the capacitors accumulates the electric charge for 1/60th of a second.

The imaging device 35 captures an image of an area 20 (refer to FIG. 5) that includes the specific position 24 on the bed 11, and generates captured image data, which is data of the captured image. Hereinafter, the area 20 that includes the specific area 24 on the bed 11 is referred to as the image capture area 20. Hereinafter, the image captured by the imaging device 35 is referred to as a captured image.

The imaging device 35 is configured such that an image capture mode of the imaging device 35 can be switched between a first mode and a second mode, by switching an aperture, a sensitivity, and the like, for example. The first mode is an image capture mode that is set in a case where the laser light is irradiated intermittently. The second mode is an image capture mode that is set when the irradiation of the laser light is stopped (namely, in a case where the laser light is not irradiated). An amount of light that is acquired at a time of image capture by the imaging device 35 in the first mode is less than an amount of light acquired at a time of image capture by the imaging device 35 in the second mode. In other words, the captured image when the imaging device 35 performs image capture in the first mode is darker than the captured image when the imaging device 35 performs image capture in the second mode.

Main coordinate systems that are set on the sewing machine 1 will be explained with reference to FIGS. 1 and 2. A world coordinate system 100 (refer to FIG. 1), a camera coordinate system 200 (refer to FIG. 2), and a laser device coordinate system 300 (refer to FIG. 1) are set on the sewing machine 1. These coordinate systems are shown schematically in FIGS. 1 and 2. The world coordinate system 100 is a three-dimensional coordinate system that shows the whole of space. In the present embodiment, an origin point of the world coordinate system 100 is set as the specific position 24. An Xw axis direction of the world coordinate system 100 is set as the left-right direction, a Yw axis direction is set as the front-rear direction and a Zw axis direction is set as the up-down direction.

The camera coordinate system 200 is a three-dimensional coordinate system of the imaging device 35. A Zc axis direction of the camera coordinate system 200 is set as an optical axis direction of the imaging device 35. An Xc axis direction and a Yc axis direction of the camera coordinate system 200 are set as directions that are mutually orthogonal on a plane that is orthogonal to the Zc axis. The laser device coordinate system 300 is a three-dimensional coordinate system of the laser device 53. A Za axis direction of the laser device coordinate system 300 is set as an optical axis direction of the laser device 53. An Xa axis direction and a Ya axis direction of the laser device coordinate system 300 are set as directions that are mutually orthogonal on a plane that is orthogonal to the Za axis.

Operations of the sewing machine 1 will be briefly explained. The sewing workpiece 10 (refer to FIG. 5) is arranged on the bed 11 such that the sewing workpiece 10 covers the specific position 24. The needle bar up-and-down movement mechanism 34, the feed mechanism and the shuttle mechanism may be driven in a state in which the sewing workpiece 10 is pressed from above by the presser foot 9. The sewing may be performed by a stitch being formed on the sewing workpiece 10 that is fed by the feed dog (not shown in the drawings) by the sewing needle 7 working in concert with the shuttle mechanism.

Figure 3:
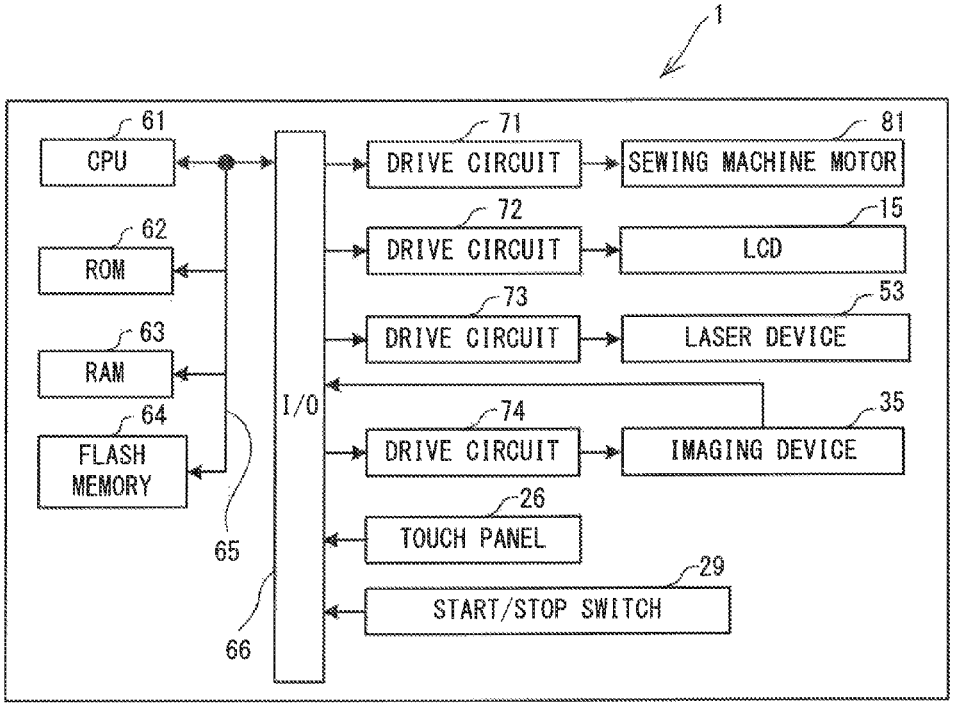
FIG. 3 is a block diagram showing an electrical configuration of the sewing machine according to the first embodiment.

An electrical configuration of the sewing machine 1 will be explained with reference to FIG. 3. The sewing machine 1 includes the CPU 61 as well as a ROM 62, a RAM 63, a flash memory 64, and an input/output interface (I/O) 66, which are connected to the CPU 61 via a bus 65.

The CPU 61 performs overall control of the sewing machine 1 and executes various arithmetic calculations and processing relating to sewing, in accordance with various programs stored in the ROM 62. Although not shown in the drawings, the ROM 62 includes various storage areas, such as a program storage area, a settings storage area, an internal variable storage area, an external variable storage area, and a calculation formula storage area. Various programs to operate the sewing machine 1 are stored in the program storage area. The various programs include, for example, a program that causes the sewing machine 1 to perform thickness identification processing, which will be explained below. Setting values and the like that are used when the image capture mode of the imaging device 35 is switched are stored in the settings storage area. The internal variable storage area, the external variable storage area, and the calculation formula storage area will be explained below.

The RAM 63 includes, as necessary, storage areas for storing arithmetic calculation results etc. of arithmetic calculation processing by the CPU 61. The flash memory 64 stores various parameters etc. that are used by the sewing machine 1 to perform various processing. The parameters include parameters associating a coordinate system of a captured image with the world coordinate system 100. Drive circuits 71 to 74, the touch panel 26, and the start/stop switch 29 are connected to the I/O 66.

A sewing machine motor 81 is connected to the drive circuit 71. The drive circuit 71 drives the sewing machine motor 81 in accordance with a control signal from the CPU 61. In accordance with the driving of the sewing machine motor 81, the needle bar up-and-down movement mechanism 34 (refer to FIG. 2) is driven via a drive shaft (not shown in the drawings) of the sewing machine 1, and the needle bar 6 is thus moved up and down. The LCD 15 is connected to the drive circuit 72. The drive circuit 72 causes the LCD to display an image by driving the LCD 15 in accordance with a control signal from the CPU 61. The laser device 53 is connected to the drive circuit 73. The drive circuit 73 causes the laser device 53 to perform the pulsed light emission in accordance with a control signal from the CPU 61.

The imaging device 35 is connected to the drive circuit 74. The drive circuit 74 sets the image capture mode of the imaging device 35 to one of the first mode and the second mode and causes the imaging device 35 to perform the image capture in accordance with a control signal from the CPU 61. The image capture data generated by the imaging device 35 is stored in a specific storage area of the RAM 63 (refer to FIG. 3).

The internal variable storage area of the ROM 62 will be explained. $A_c$ and $A_p$ are stored as data in the internal variable storage area. $A_p$ is a camera internal matrix of the imaging device 35. $A_p$ is a matrix that is regarded as a camera internal matrix of the laser device 53. $A_c$ is a 3×3 matrix (three rows and three columns), and includes internal variables of the imaging device 35. The internal variables of the imaging device 35 are parameters that are prescribed based on characteristics of the imaging device 35 and are used to perform various corrections, such as correcting a focal distance, a displacement of principal point coordinates, and distortion of a captured image. More specifically, the internal variables of the imaging device 35 are an X-axis focal distance, a Y-axis focal distance, X-axis principal point coordinates, Y-axis principal point coordinates, a first distortion coefficient, and a second distortion coefficient of the imaging device 35. The X-axis focal distance indicates a displacement in the focal distance in the Xc axis direction of the imaging device 35. The Y-axis focal distance indicates a displacement in the focal distance in the Yc axis direction of the imaging device 35. The X-axis principal point coordinates indicate a displacement of the principal point in the Xc axis direction of the imaging device 35. The Y-axis principal point coordinates indicate a displacement of the principal point in the Yc axis direction of the imaging device 35. The first distortion coefficient and the second distortion coefficient respectively indicate distortion caused by tilting of a lens of the imaging device 35. $A_c$ is used in processing to convert the image captured by the imaging device 35 to a normalized image, for example. Further, $A_c$ is used in processing that identifies a position at which the laser light is irradiated on the sewing workpiece 10, for example. The normalized image is an image captured by a normalized camera. The normalized camera is a camera for which a distance from an optical center to a screen surface is a unit length.

$A_p$ is a 3×3 matrix (three rows and three columns) and is regarded as an internal matrix that includes internal variables of the laser device 53. The laser device 53 does not have camera internal variables. For sake of simplicity, $A_p$ is set as a unit matrix such that it can be used in a calculation formula (to be explained below) used to calculate a thickness of the sewing workpiece 10.

The external variable storage area of the ROM 62 will be explained. $R_c$, $t_c$, $R_p$, and $t_p$ are stored as data in the external variable storage area. $R_c$ is a rotation matrix of the imaging device 35. $t_c$ is a translation vector of the imaging device 35. $R_p$ is a rotation matrix of the laser device 53. $t_p$ is a translation vector of the laser device 53. $R_c$ and $t_c$ are prescribed by external variables of the imaging device 35. $R_p$ and $t_p$ are prescribed by external variables of the laser device 53. The external variables of the imaging device 35 are parameters indicating an installation state (a position and an orientation) of the imaging device 35 with respect to the world coordinate system 100. The external variables of the imaging device 35 indicate a displacement between the camera coordinate system 200 and the world coordinate system 100. The external variables of the laser device 53 are parameters indicating an installation state (a position and an orientation) of the laser device 53 with respect to the world coordinate system 100. The external variables of the laser device 53 are parameters indicating a displacement between the laser device coordinate system 300 and the world coordinate system 100. $R_c$, $t_c$, $R_p$, and $t_p$ will be explained below.

$R_c$ is a 3×3 rotation matrix that is used by the sewing machine 1 to convert three-dimensional coordinates of the camera coordinate system 200 to three-dimensional coordinates of the world coordinate system 100. $R_c$ is prescribed based on an X-axis rotation vector, a Y-axis rotation vector, and a Z-axis rotation vector, which are external variables of the imaging device 35. The X-axis rotation vector indicates a rotation of the camera coordinate system 200 with respect to the world coordinate system 100 around an Xw-axis. The Y-axis rotation vector indicates a rotation of the camera coordinate system 200 with respect to the world coordinate system 100 around a Yw-axis. The Z-axis rotation vector indicates a rotation of the camera coordinate system 200 with respect to the world coordinate system 100 around a Zw-axis. The X-axis rotation vector, the Y-axis rotation vector, and the Z-axis rotation vector are used when the sewing machine 1 determines a conversion matrix to convert three-dimensional coordinates of the camera coordinate system 200 to three-dimensional coordinates of the world coordinate system 100 and a conversion matrix to convert three-dimensional coordinates of the world coordinate system 100 to three-dimensional coordinates of the camera coordinate system 200.

$t_c$ is a 3×1 translation vector that is used by the sewing machine 1 to convert three-dimensional coordinates of the camera coordinate system 200 to three-dimensional coordinates of the world coordinate system 100. $t_c$ is prescribed based on an X-axis translation vector, a Y-axis translation vector, and a Z-axis translation vector, which are external variables of the imaging device 35. The X-axis translation vector indicates a displacement in the Xw-axis direction of the camera coordinate system 200 with respect to the world coordinate system 100. The Y-axis translation vector indicates a displacement in the Yw-axis direction of the camera coordinate system 200 with respect to the world coordinate system 100. The Z-axis translation vector indicates a displacement in the Zw-axis direction of the camera coordinate system 200 with respect to the world coordinate system 100. The X-axis translation vector, the Y-axis translation vector, and the Z-axis translation vector are used when the sewing machine 1 determines a translation vector to convert three-dimensional coordinates of the world coordinate system 100 to three-dimensional coordinates of the camera coordinate system 200 and a translation vector to convert three-dimensional coordinates of the camera coordinate system 200 to three-dimensional coordinates of the world coordinate system 100.

$R_p$ is a 3×3 rotation matrix that is used by the sewing machine 1 to convert three-dimensional coordinates of the laser device coordinate system 300 to three-dimensional coordinates of the world coordinate system 100. $R_p$ is prescribed based on an X-axis rotation vector, a Y-axis rotation vector, and a Z-axis rotation vector, which are external variables of the laser device 53. The X-axis rotation vector indicates a rotation of the laser device coordinate system 300 with respect to the world coordinate system 100 around the Xw-axis. The Y-axis rotation vector indicates a rotation of the laser device coordinate system 300 with respect to the world coordinate system 100 around the Yw-axis. The Z-axis rotation vector indicates a rotation of the laser device coordinate system 300 with respect to the world coordinate system 100 around the Zw-axis. The X-axis rotation vector, the Y-axis rotation vector, and the Z-axis rotation vector are used when the sewing machine 1 determines a conversion matrix to convert three-dimensional coordinates of the laser device coordinate system 300 to three-dimensional coordinates of the world coordinate system 100 and a conversion matrix to convert three-dimensional coordinates of the world coordinate system 100 to three-dimensional coordinates of the laser device coordinate system 300.

$t_p$ is a 3×1 translation vector that is used by the sewing machine 1 to convert three-dimensional coordinates of the laser device coordinate system 300 to three-dimensional coordinates of the world coordinate system 100. $t_p$ is prescribed based on an X-axis translation vector, a Y-axis translation vector, and a Z-axis translation vector, which are external variables of the laser device 53. The X-axis translation vector indicates a displacement in the Xw-axis direction of the laser device coordinate system 300 with respect to the world coordinate system 100. The Y-axis translation vector indicates a displacement in the Yw-axis direction of the laser device coordinate system 300 with respect to the world coordinate system 100. The Z-axis translation vector indicates a displacement in the Zw-axis direction of the laser device coordinate system 300 with respect to the world coordinate system 100. The X-axis translation vector, the Y-axis translation vector, and the Z-axis translation vector are used when the sewing machine 1 determines a translation vector to convert three-dimensional coordinates of the world coordinate system 100 to three-dimensional coordinates of the laser device coordinate system 300 and a translation vector to convert three-dimensional coordinates of the laser device coordinate system 300 to three-dimensional coordinates of the world coordinate system 100.

The calculation formula storage area of the ROM 62 will be explained. Calculation formulas that are used to identify the thickness of the sewing workpiece 10 (refer to FIG. 5) are stored in the calculation formula storage area. The thickness of the sewing workpiece 10 is a dimension in the Zw-axis direction of the sewing workpiece 10 that is placed on the bed 11. In other words, the thickness of the sewing workpiece 10 is a distance in the Zw-axis direction from the top surface of the bed 11 to the top surface of the sewing workpiece 10. The calculation formulas used to identify the thickness of the sewing workpiece 10 assume as a prerequisite that a position of the sewing workpiece 10 placed on the bed 11 does not change.

The thickness of the sewing workpiece 10 is identified by identifying irradiated coordinates and converting the identified irradiated coordinates into three-dimensional coordinates of the world coordinate system 100. The irradiated coordinates are coordinates on the captured image of a position 25 (refer to FIG. 5), which is a position at which the laser device 53 irradiates the laser light onto the sewing workpiece 10. Hereinafter, the position 25 at which the laser device 53 irradiates the laser light onto the sewing workpiece 10 is referred to as the irradiated position 25. The irradiated position 25 is a specific position on the sewing workpiece 10. When the sewing workpiece 10 is not placed on the bed 11, a position at which the laser device 53 irradiates the laser light is the specific position 24. When the sewing workpiece 10 is placed, the position at which the laser device 53 irradiates the laser light is the irradiated position 25.

The calculation formulas stored in the calculation formula storage area will be explained. Three dimensional coordinates in the world coordinate system 100 of irradiated coordinates are calculated by applying a calculation method that uses parallax between two cameras that are placed in two different positions to calculate three-dimensional coordinates of a congruent point whose images are captured by the two cameras. In the calculation method that uses the parallax, three-dimensional coordinates of the camera coordinate system 200 are calculated in the following manner. If image coordinates $m=(u, v)^T$ and $m'=(u', v')^T$ of the congruent point whose images are captured by the two cameras placed in the two different positions are already known, Formulas (1) and (2) are obtained.

$$sm_{av}=PMw_{av} \quad \text{Formula (1):}$$

$$s'm_{av}'=P'Mw_{av} \quad \text{Formula (2):}$$

In Formula (1), P is a projection matrix of the camera that obtains the image coordinates $m=(u, v)^T$. In Formula (2), P' is a projection matrix of the camera that obtains the image coordinates $m'=(u', v')^T$. The projection matrices are matrices that include an internal variable and an external variable of the camera. $m_{av}$ is an expansion vector of m. $m_{av}'$ is an expansion vector of m'. $Mw_{av}$ is an expansion vector of Mw. Mw is a three-dimensional coordinate of the world coordinate system 100. The expansion vectors are obtained by adding an element 1 to a given vector. For example, the expansion vector of $m=(u, v)^T$ is $m_{av}=(u, v, 1)^T$. s and s' represent scalars.

From Formulas (1) and (2), Formula (3) is obtained.

$$BMw=b \quad \text{Formula (3):}$$

In Formula (3), B is a 4×3 matrix (four rows and three columns). An element Bij of a row i and a column j of B is represented by Formula (4). b is represented by Formula (5).

$$(B_{11},B_{21},B_{31},B_{41},B_{12},B_{22},B_{32},B_{42},B_{13},B_{23},B_{33},B_{43})=(up_{31}-p_{11},vp_{31}-p_{21},u'p_{31}'-p_{11}',v'p_{31}'-p_{21}',up_{32}-p_{12},vp_{32}-p_{22},u'p_{32}'-p_{12}',v'p_{32}'-p_{22}',up_{33}-p_{13},vp_{33}-p_{23},u'p_{33}'-p_{13}',vp_{33}'-p_{23}') \quad \text{Formula (4):}$$

$$b=[p_{14}-up_{34},p_{24}-vp_{34},p_{14}'-u'p_{34}',p24'-v'p_{34}']^T \quad \text{Formula (5):}$$

In Formulas (4) and (5), $p_{ij}$ is an element of a row i and a column j of P, and pij' is an element of a row i and a column j of P'. $[p_{14}-up_{34}, p_{24}-vp_{34}, p_{14}'-u'p_{34}', p_{24}'-v'p_{34}]^T$ is a transposed matrix of $[p_{14}-up_{34}, p_{24}-vp_{34}, p_{14}'-u'p_{34}', p_{24}'-v'p_{34}]$.

Thus, Mw is represented by Formula (6).

$$Mw=B^+b. \quad \text{Formula (6):}$$

In Formula (6), $B^+$ represents a pseudo inverse matrix of the matrix B.

Here, it is assumed that, of the above-described two cameras, one of the cameras is the imaging device 35 and the other camera is the laser device 53. The irradiated position 25 is the congruent point. The image coordinates of the irradiated position 25 in the image captured by the imaging device 35 are $m=(u, v)^T$. The coordinates of the irradiated position 25 of the laser device coordinate system 300 are $m'=(u', v')^T$. A projection matrix of the imaging device 35 is set as P in Formula (1). The projection matrix of the imaging device 35 is expressed by Formula (7). Similarly, a projection matrix of the laser device 53 is set as P' in Formula (2). The projection matrix of the laser device 53 is expressed by Formula (8).

$$P=A_c[R_c,t_c] \quad \text{Formula (7):}$$

$$P'=A_p[R_p,t_p] \quad \text{Formula (8):}$$

Ap is the unit matrix, so it is possible to substitute Formula (9) for a Formula (8).

$$P'=[R_p,t_p] \quad \text{Formula (9):}$$

Using m, m', P and P' that are obtained in the above-described manner, the three-dimensional coordinates Mw in the world coordinate system 100 are calculated based on Formula (6). Of the three-dimensional coordinates Mw (Xw, Yw, Zw) of the irradiated position 25 in the world coordinate system 100, Zw represents the thickness of the sewing workpiece 10. The above-described Formulas (1) to (9) are stored in the calculation formula storage area as data in which the irradiated coordinates and a distance from the top surface of the bed 11 are associated with each other. Hereinafter, the above-described Formulas (1) to (9) are referred to as thickness calculation formulas.

Figure 5:
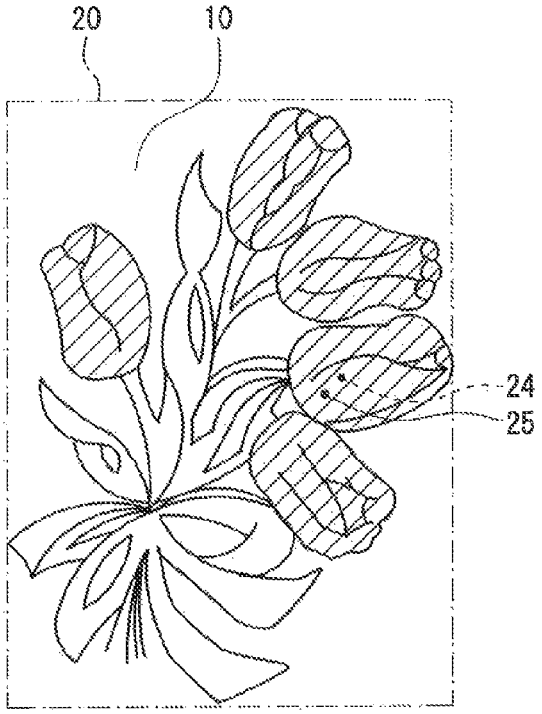
FIG. 5 is a plan view showing a sewing workpiece which is arranged in an image capture area and onto which laser light is irradiated.
Figure 6:
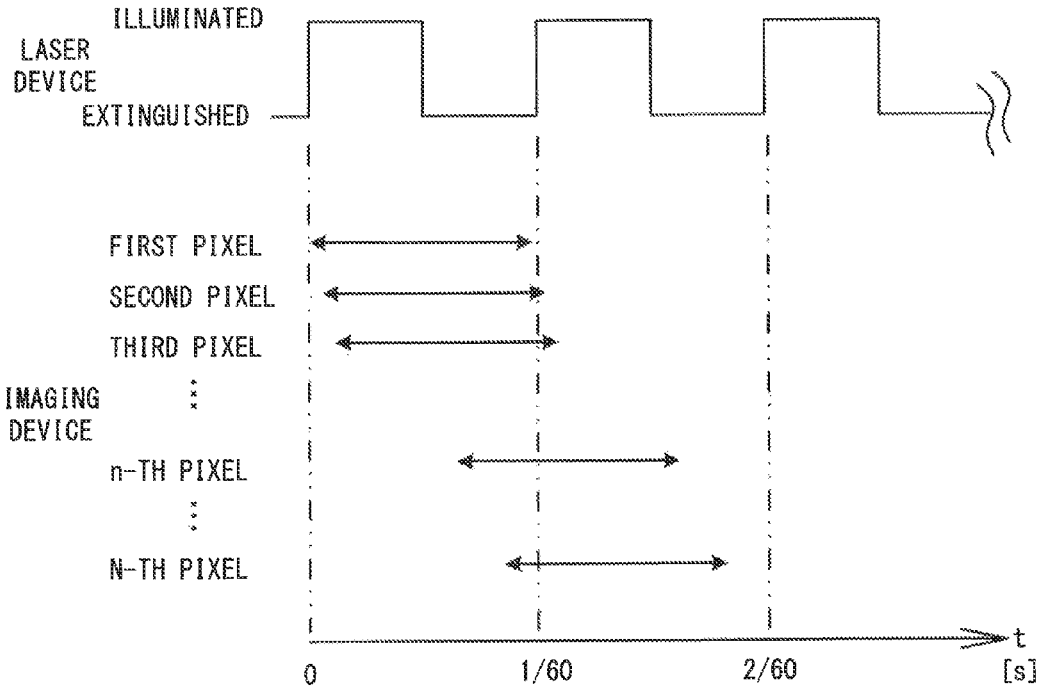
FIG. 6 is an explanatory diagram showing timings of pulsed light emission by a laser device and exposure by the imaging device in the first embodiment.

Thickness identification processing that is performed by the sewing machine 1 will be explained with reference to FIGS. 4 to 6. A user may arrange the sewing workpiece 10 (refer to FIG. 5) on the bed 11. After that, the thickness identification processing is performed when the user inputs a start command to the sewing machine 1 by a panel operation. The sewing workpiece 10 arranged on the bed 11 may cover the specific position 24. In the present embodiment, it is assumed that a flower pattern is formed on a portion, of the sewing workpiece 10, that is arranged in the image capture area 20 (refer to FIG. 5).

When the CPU 61 detects the start command by the panel operation, the CPU 61 refers to the program storage area of the ROM 62 and reads a program to execute the thickness identification processing into the RAM 63. The CPU 61 executes processing of each of steps that are explained below, in accordance with commands included in the program. Various data that are obtained in the course of the processing are stored as necessary in the RAM 63.

The CPU 61 controls the drive circuit 74 and sets the image capture mode of the imaging device 35 to the first mode (step S11). The CPU 61 controls the laser device 53 to intermittently irradiate the laser light onto the irradiated position 25 (step S13). The laser device 53 starts the pulsed light emission. As shown in FIG. 5, in the present embodiment, the irradiated position 25 is overlapped with the pattern on the sewing workpiece 10 and is positioned substantially above the specific position 24.

Figure 4:
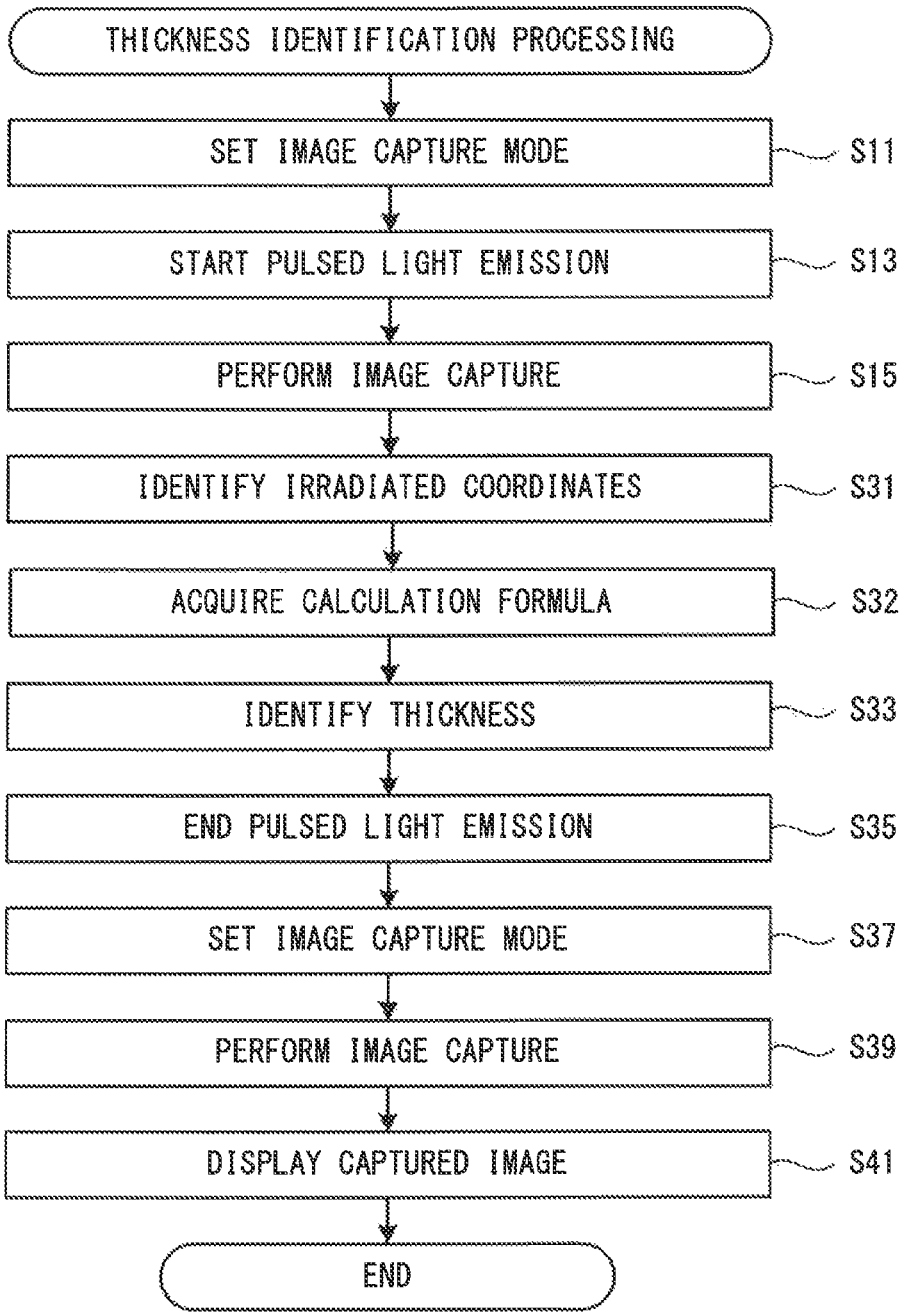
FIG. 4 is a flowchart of thickness identification processing according to the first embodiment.

As shown in FIG. 4, in synchronization with the irradiation on the irradiated position 25 by the laser device 53, the CPU 61 controls the drive circuit 74 to cause the imaging device 35 to capture an image of the image capture area 20, acquiring generated captured image data (step S15).

The CPU 61 starts the image capture by the imaging device 35 simultaneously with the start of the pulsed light emission by the laser device 53. When the image capture by the imaging device 35 is started, exposure corresponding to each of the pixels of an image captured by the imaging device 35 is performed. More specifically, exposure by the imaging device 35 is performed such that a timing to start exposure for each of the pixels is different for each of the pixels, and an exposure time period is substantially the same for each of the pixels. An electric current that accords with an amount of received light is generated in each of the phototransistors corresponding to each of the pixels. In this manner, an electric charge is accumulated in each of the capacitors corresponding to each of the phototransistors. The accumulated electric charge is read by the CPU 61.

It is assumed that the total number of the pixels that form the image captured by the imaging device 35 is N. It is assumed that numbers are assigned sequentially to the N pixels and the irradiated position 25 is included in a pixel in an n-th position (hereinafter referred to as an n-th pixel). The n-th pixel may be a plurality of the pixels. FIG. 6 shows timings at which exposure is performed for each of the N pixels and timings at which the pulsed light emission is performed by the laser device 53. When the exposure of the n-th pixel is started, even if the laser light is not being irradiated onto the irradiated position 25 (the light source is extinguished), the exposure is performed for 1/60th of a second. Therefore, when the pulsed light emission is performed for a second time, at least part of the time in which the laser light is irradiated onto the irradiated position 25 (the light source is illuminated) overlaps with the time at which exposure of the n-th pixel is performed. Even when the timing at which the exposure by the imaging device 35 is started is set to be displaced from the timing at which the pulsed light emission is started for the first time, the time of exposure of the n-th pixel and the time of the irradiation of the laser light onto the irradiated position 25 reliably overlap. Thus, the imaging device 35 can capture an image of the laser light that is irradiated onto the irradiated position 25, irrespective of the timing at which the laser light is irradiated onto the irradiated position 25. As a result, the sewing machine 1 can flexibly set the timing at which the exposure by the imaging device 35 is started.

As shown in FIG. 4, based on the captured image data acquired at step S15, the CPU 61 identifies irradiated coordinates (step S31). The irradiated coordinates are identified by performing image processing of known technology. For example, a Hough transform may be performed on the captured image and a Hough transformed image may be generated. Next, non-maximum suppression processing may be performed on the Hough transformed image and, a bright point in the Hough transformed image may be locally extracted (within a mask). As a result, the irradiated coordinates may be identified.

As the laser device 53 irradiates the laser light intermittently, the laser device 53 can reduce an average value of a laser light output. As a result, the laser device 53 can appropriately raise the output of the laser light to a level at which the imaging device 35 easily recognizes the irradiated position 25, while satisfying standards established in compliance with safety criteria of laser products. The laser device 53 can irradiate the laser light onto the irradiated position 25 only. Even if the irradiated position 25 overlaps the pattern of the sewing workpiece 10, inside the image capture area 20, a contrast between the irradiated position 25 and an area that is not irradiated by the laser light may be larger. Therefore, the irradiated position 25 may be easily identified. Further, the captured image captured by the imaging device 35 in the first mode may be dark and therefore the laser light may be more easily recognized. Accordingly, the irradiated position 25 may be more easily identified in the captured image.

The CPU 61 refers to the ROM 62 and acquires the thickness calculation formula (step S32). The CPU 61 calculates the thickness of the sewing workpiece 10 (step S33), based on the irradiated coordinates acquired at step S31, the thickness calculation formula acquired at step S32 and $A_c$, $A_p$, $R_c$, $t_c$, $R_p$, and $t_p$ that are acquired by referring to the ROM 62.

The CPU 61 controls the drive circuit 73 to end the pulsed light emission by the laser device 53 (step S35). The CPU 61 controls the drive circuit 74 to set the image capture mode of the imaging device 35 to the second mode (step S37). In this way, the amount of light acquired by the imaging device 35 at the time of image capture increases. The CPU 61 controls the drive circuit 74 to cause the imaging device 35 in the second mode to capture an image of the image capture area 20, acquiring the generated captured image data (step S39).

Based on the captured image data acquired at step S39, the CPU 61 controls the drive circuit 72 to cause the LCD to display the captured image (step S41). After that, the CPU 61 ends the thickness identification processing. The captured image captured by the imaging device 35 in the second mode is brighter than the captured image captured in the first mode. Thus, it is possible to brighten the captured image that is displayed on the LCD 15.

As described above, the irradiated coordinates, which are the coordinate data of the irradiated position 25 in the captured image, are identified by the sewing machine 1 (step S31). In other words, the sewing machine 1 can identify the irradiated coordinates in a stable manner, based on the captured image data, without being influenced by the color and the design of the sewing workpiece 10.

The imaging device 35 is a rolling shutter type imaging device. Therefore, the imaging device 35 can capture an image of the irradiated laser light, irrespective of a timing at which the laser light is irradiated. Therefore, in a case where the captured image is captured in order to identify the irradiated coordinates, it is possible to relatively freely set the timing at which the exposure by the imaging device 35 is started.

The sewing machine 1 can switch the image capture mode of the imaging device 35 to one of the first mode and the second mode (step S11, step S37). The first mode is the image capture mode that is set in a case where the laser light is intermittently irradiated onto the irradiated position 25. The second mode is the image capture mode that is set in a case where the irradiation of the laser light onto the irradiated position 25 is stopped (namely, in a case where the laser light is not irradiated). Therefore, the sewing machine 1 can cause the imaging device 35 to perform the image capture that is suitable for identifying the thickness of the sewing workpiece 10 and the image capture that is suitable for capturing an image of the sewing workpiece 10 and displaying the captured image on the LCD 15.

The sewing machine 1 identifies the thickness of the sewing workpiece 10 (step S33) based on the irradiated coordinates identified at step S31 and the calculation formula acquired at step S32. Thus, the sewing machine 1 can identify the thickness of the sewing workpiece 10 in a stable manner based on the captured image data, without being influenced by the color and the design of the sewing workpiece 10.

Figure 7:
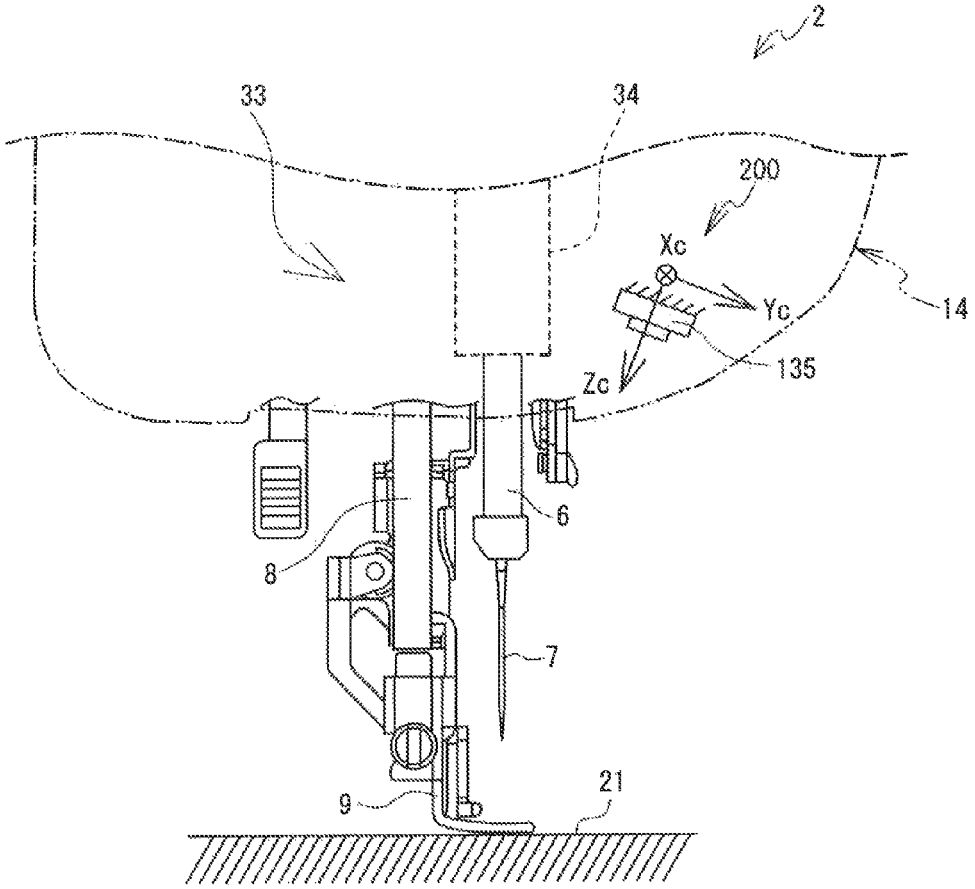
FIG. 7 is an explanatory diagram showing a configuration in the vicinity of an imaging device according to a second embodiment.

Next, a sewing machine 2 according to a second embodiment will be explained with reference to FIGS. 7 and 8. An explanation of a configuration that is the same as that of the sewing machine 1 of the first embodiment will be simplified or omitted. Unlike the sewing machine 1, the sewing machine 2 includes an imaging device 135 in place of the imaging device 35. The imaging device 135 is a global shutter type imaging device. The imaging device 135 includes a charge coupled device (CCD) image sensor. The imaging device 135 generates captured image data, which is data of a captured image that includes the specific position 24. A shutter speed of the imaging device 135 of the present embodiment is 1/120th of a second, which is the same time period as one cycle at which the laser device 53 irradiates the laser light. When the exposure by the imaging device 135 is performed, each of the phototransistors provided in the CCD image sensor of the imaging device 135 simultaneously receive light for 1/120th of a second.

Similarly to the imaging device 35, the imaging device 135 is configured such that the image capture mode can be switched between the first mode and the second mode. A cycle T (1/60th of a second), at which the laser device 53 irradiates the laser light, and the shutter speed of the imaging device 135 ($1/120^{th}$ of a second) are stored in a storage area (not shown in the drawings) in the flash memory 64.

Although not shown in the drawings, the imaging device 135 is connected to a drive circuit that can set the image capture mode of the imaging device 135 to one of the first mode and the second mode in accordance with a control signal from the CPU 61 and cause the imaging device 135 to perform the image capture. The sewing machine 2 includes a timer (not shown in the drawings) connected to the CPU 61.

Thickness identification processing performed by the sewing machine 2 will be explained with reference to FIG. 8. The same step numbers are assigned to processing steps that are the same as those of the thickness identification processing (refer to FIG. 4) performed by the sewing machine 1 according to the first embodiment, and an explanation thereof is simplified. The CPU 61 controls the drive circuit (not shown in the drawings) that is connected to the imaging device 135 and sets the image capture mode of the imaging device 135 to the first mode (step S11). The CPU 61 causes the laser device 53 to perform the pulsed light emission (step S13). The CPU 61 causes the timer to start timing at the same time as the timing at which the pulsed light emission is started.

The CPU 61 acquires the cycle T by referring to the flash memory 64 (step S21). The CPU 61 acquires the timing at which the laser device 53, which performs the pulsed light emission, starts to irradiate the irradiated position 25 (refer to FIG. 5) (step S23). Hereinafter, the timing at which the laser device 53 starts to irradiate the irradiated position 25 (refer to FIG. 5) is referred to as a light emission start timing. The CPU 61 acquires the light emission start timing by multiplying the cycle T (1/60th of a second) acquired at step S21 by an integer that is equal to or greater than zero. For example, the light emission start timing is 0 seconds, 1/60th of a second, 2/60th of a second, 3/60th of a second as counted by the timer.

The CPU 61 determines a timing at which the imaging device 135 starts the image capture (step S25), based on the cycle T acquired at step S21 and the light emission start timing acquired at step S23. Hereinafter, the timing at which the imaging device 135 starts the image capture is referred to as an image capture start timing. The CPU 61 determines the image capture start timing such that the exposure by the imaging device 135 is started during the time period in which the irradiated position 25 is being irradiated. For example, the CPU 61 determines the start of the image capture to be at the time that the timer times 3/60th of a second (the time at which the pulsed light emission is started for a fourth time).

The CPU 61 controls the drive circuit (not shown in the drawings) to cause the imaging device 135 to start the image capture by the imaging device 135, acquiring the generated captured image data (step S27). For example, the CPU 61 causes the imaging device 135 to start the image capture when the timer times 3/60th of a second. The imaging device 135 performs the image capture while the exposure start timings of each of the pixels of the captured image captured by the imaging device 135 are substantially the same and the exposure time periods of each of the pixels are substantially the same.

Figure 9:
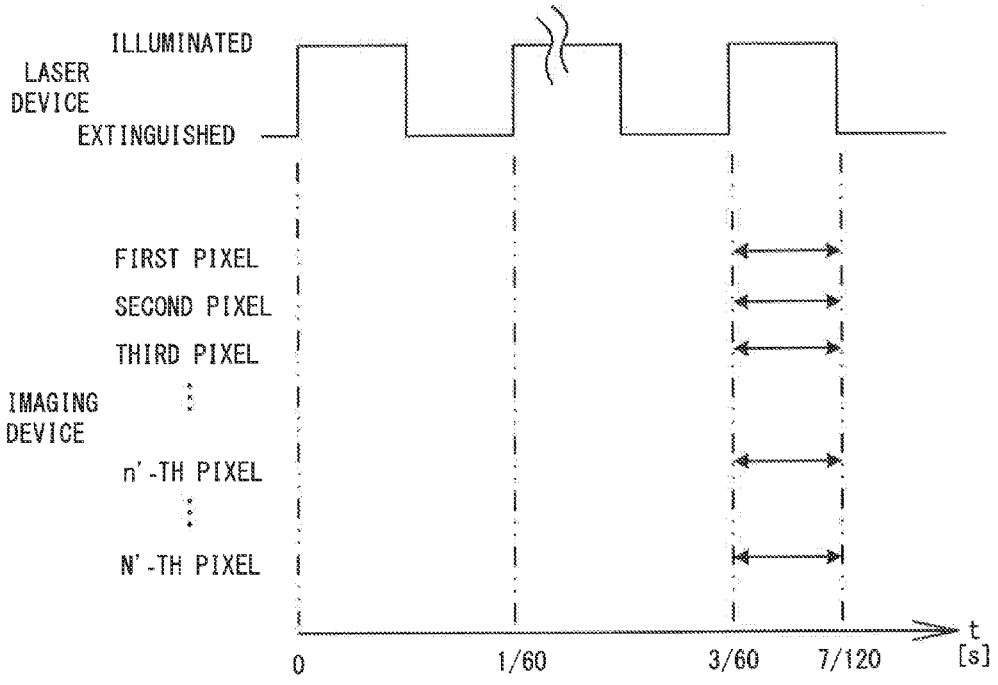
FIG. 9 is an explanatory diagram showing timings of pulsed light emission by the laser device and exposure by the imaging device in the second embodiment.

The shutter speed is the same as the time period of one cycle at which the laser light is irradiated onto the irradiated position 25. Thus, when the pulsed light emission is performed for the fourth time, the irradiation of the laser light onto the irradiated position 25 is stopped and simultaneously, the exposure by the imaging device 135 ends. Here, the total number of the pixels that configure the captured image captured by the imaging device 135 is N'. It is assumed that numbers are assigned sequentially to the N' pixels and the irradiated position 25 is included in a pixel in an n'-th position (hereinafter referred to as an n'-th pixel). FIG. 9 shows timings at which exposure is performed for each of the N' pixels and timings at which the pulsed light emission is performed by the laser device 53. The exposure of all the N' pixels is started simultaneously. Thus, during a time period in which the timer times from 3/60th of a second up to 7/120th of a second (=3/60th of a second+1/120th of a second), the phototransistor corresponding to the n'-th pixel receives the laser light.

During the time of the exposure of the imaging device 135, namely, during the time in which an image of the image capture area 20 (refer to FIG. 5) is being captured, the CPU 61 causes the imaging device 135 to perform the image capture under a condition in which a time period in which the laser light is irradiated onto the irradiated position 25 (1/120th of a second in the present embodiment) is longer than a time period in which the irradiation of the irradiated position 25 is stopped (zero seconds in the present embodiment). Therefore, an amount of the laser light acquired at the time of the image capture by the imaging device 135 is larger.

Figure 8:
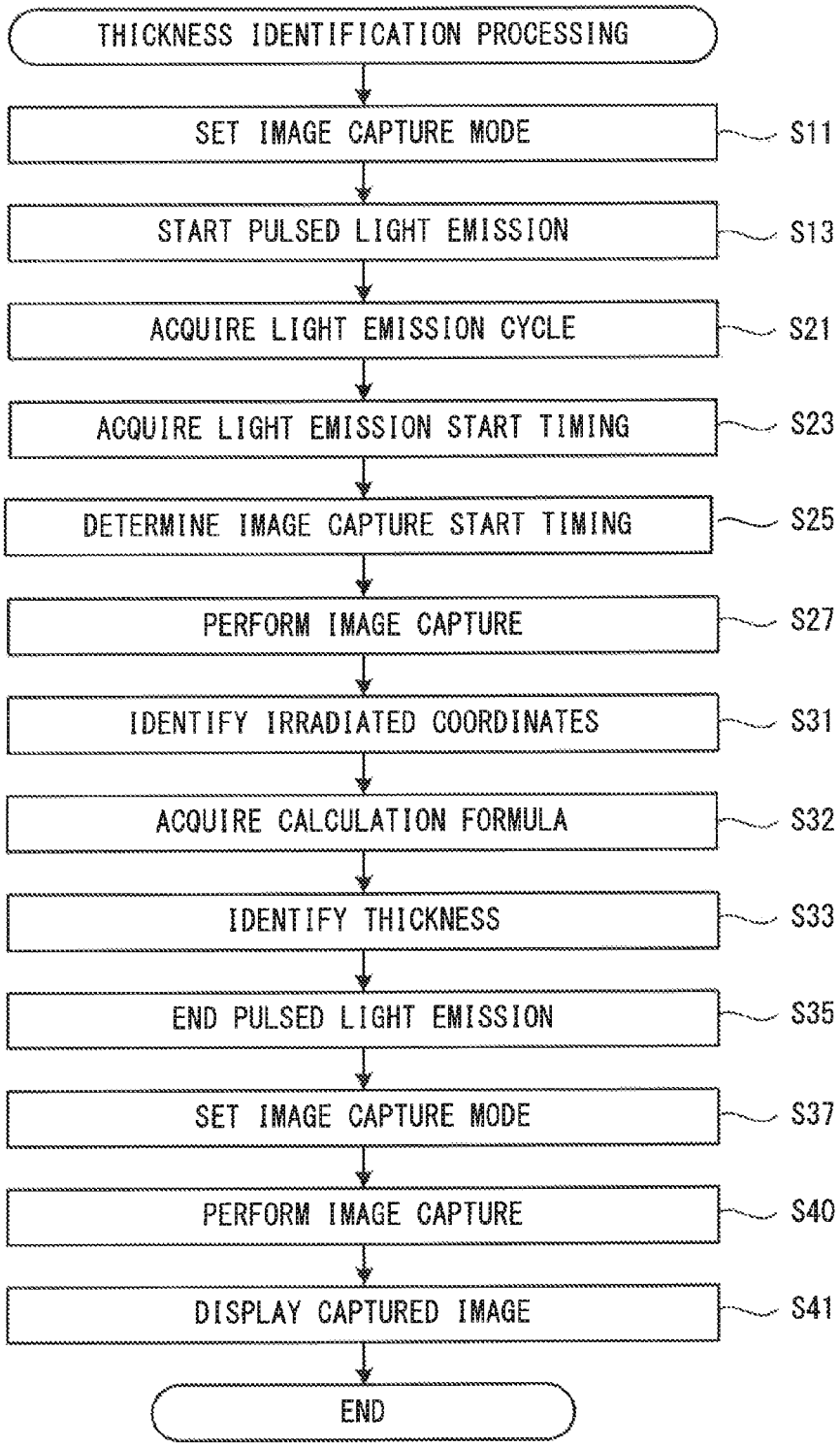
FIG. 8 is a flowchart of thickness identification processing according to the second embodiment.

As shown in FIG. 8, the CPU 61 performs the processing from step S31 to step S37 in a similar manner to the thickness identification processing by the sewing machine 1 according to the first embodiment. After that, the CPU 61 causes the imaging device 135 to perform the image capture (step S40) in a similar manner to the processing at step S39, and causes the LCD 15 to display the captured image (step S41). After that, the CPU 61 ends the thickness identification processing by the sewing machine 2.

As described above, in the sewing machine 2 according to the second embodiment, the exposure by the imaging device 135 is started during the time in which the laser device 53 irradiates the laser light onto the irradiated position 25. The imaging device 135 can easily acquire the laser light irradiated onto the irradiated position 25. Thus, the sewing machine 2 can identify the position of the laser light in a stable manner.

During the time in which the imaging device 135 is capturing the image of the image capture area 20, the time period in which the laser light is being irradiated onto the irradiated position 25 is longer than the time period in which the irradiation of the laser light onto the irradiated position 25 is temporarily stopped. Therefore, the amount of laser light acquired by the imaging device 135 at the time of the image capture is larger. As a result, the sewing machine 2 can identify the position of the laser light in a more stable manner.

Various modifications can be made to the above-described embodiments. Only a single image capture mode that is suited to the image capture of the sewing workpiece 10 irradiated by the laser light may be set on the imaging device 35, 135. In this case, in the thickness identification processing, the imaging device 35 may generate the captured image that is captured only in the single image capture mode, without the first mode or the second mode being set.

The imaging device 35, 135 may perform the image capture a plurality of times of the sewing workpiece 10 irradiated by the laser light. In this case, the CPU 61 may select, from among a plurality of captured images captured by the imaging device 35, 135, the captured image in which the amount of acquired laser light is largest. The irradiated coordinates may be identified based on the selected captured image.

The sewing machine 1, 2 may include a communication device that can communicate with an external information terminal via a network. In this case, the CPU 61 may acquire the thickness calculation formula by referring to data relating to a thickness calculation formula received by the communication device. The thickness calculation formula is an example of a calculation formula that is used to calculate the thickness of the sewing workpiece 10. For example, the thickness of the sewing workpiece 10 can be calculated based on the irradiated coordinates and the coordinates of the specific position 24 on the captured image. In other words, the CPU 61 may identify the coordinates of the specific position 24 and the irradiated coordinates. Then, the CPU 61 may identify the thickness of the sewing workpiece 10 by referring to a data table in which the two sets of coordinates are associated in advance with the thickness of the sewing workpiece 10.

The imaging device 35, 135 may start the image capture during the time in which the laser device 53 has temporarily stopped the irradiation of the laser light. Even in this case, it is sufficient if the time in which the imaging device 35, 135 is performing the exposure overlaps partially with the time in which the laser device 53 is performing the irradiation. In this case, the imaging device 35, 135 can generate the captured image data of the captured image that includes the laser light irradiated onto the irradiated position 25.

In the sewing machine 1 of the first embodiment, the frame rate of the imaging device 35 may be a value that is different to 60 fps. In this case, during the first exposure of the n-th pixel, it is possible that the laser light is not being irradiated onto the irradiated position 25. In this case, the CPU 61 may reset the electric charge accumulated in the capacitor corresponding to the n-th pixel and may cause the electric charge to be accumulated once more. In this way, the time during which the exposure of the n-th pixel is performed from the second time onward overlaps at least partially with the time during which the laser light is irradiated onto the irradiated position 25. Therefore, the imaging device 35 can reliably capture an image of the laser light irradiated onto the irradiated position 25.

In the sewing machine 2 of the second embodiment, the CPU 61 may acquire a timing at which the irradiation of the laser light is temporarily stopped (hereinafter referred to as a light emission stop timing), in place of the light emission start timing. In this case, the CPU 61 can determine the image capture start timing based on the light emission stop timing and the cycle T.

In the sewing machine 2 of the second embodiment, the CPU 61 acquires the cycle T by referring to the flash memory 64. The CPU 61 may acquire the cycle T using another method. For example, the CPU 61 may acquire the cycle T by measuring a time period from the start of the irradiation of the laser light to the temporary stopping of the irradiation, based on the output signal of the timer.

The above-described thickness identification processing (refer to FIGS. 4 and 8) is not limited to the example of being executed by a CPU and may be executed by another electrical component (an application specific integrated circuit (ASIC), for example). The thickness identification processing may be distributed and processed by a plurality of electronic devices (namely, by a plurality of CPUs). For example, a part of the thickness identification processing may be executed by a server that is connected to a personal computer.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a bed;

an irradiating portion configured to irradiate laser light onto a specific position on the bed;

an image capturing portion configured to capture an image of an area including the specific position on the bed and to generate captured image data being data of the captured image;

a processor; and a memory configured to store computer-readable instructions, wherein the computer-readable instructions, when executed by the processor, cause the sewing machine to perform processes comprising:

causing the irradiating portion to intermittently irradiate the laser light onto the specific position;

acquiring the captured image data by causing the image capturing portion to capture an image of the area in synchronization with irradiation on the specific position by the irradiating portion; and identifying irradiated coordinates based on the captured image data, the irradiated coordinates being coordinates, in the captured image, of an irradiated position, and the irradiated position being a position, in the area, onto which the laser light is irradiated by the irradiating portion.

2. The sewing machine according to claim 1, wherein the image capturing portion is a rolling shutter type imaging device.

3. The sewing machine according to claim 1, wherein the image capturing portion is a global shutter type imaging device, the computer-readable instructions, when executed by the processor, further cause the sewing machine to perform processes comprising:

acquiring at least one timing of a first timing and a second timing, the first timing being a timing at which the irradiating portion is caused to start the irradiation on the specific position, and the second timing being a timing at which the irradiation on the specific position is temporarily stopped; and acquiring a cycle at which the irradiating portion irradiates the laser light onto the specific position; and the acquiring the captured image data includes causing the image capturing portion to start exposure during a time in which the irradiation on the specific position is being performed, based on the acquired at least one timing and on the acquired cycle.

4. The sewing machine according to claim 3, wherein the acquiring the captured image data includes causing the image capturing portion to perform image capture of the area under a condition in which, during the image capture, a time period in which the laser light is being irradiated onto the specific position is longer than a time period in which the irradiation of the specific position is temporarily stopped.

5. The sewing machine according to claim 1, wherein the computer-readable instructions, when executed by the processor, further cause the sewing machine to perform processes comprising:

setting an image capture mode of the image capturing portion to a first mode in a case where the irradiating portion irradiates the laser light; and setting the image capture mode to a second mode in a case where the irradiating portion does not irradiate the laser light, the second mode being an image capture mode that is different to the first mode.

6. The sewing machine according to claim 1, wherein the computer-readable instructions, when executed by the processor, further cause the sewing machine to perform processes comprising:

acquiring correspondence data, the correspondence data being data in which the irradiated coordinates and a distance from the bed are associated with each other; and identifying a thickness of a sewing workpiece placed on the specific position on the bed, based on the identified irradiated coordinates and the acquired correspondence data.

* * * * *